US005391846A

United States Patent [19]

Taylor et al.

[11] Patent Number: 5,391,846

[45] Date of Patent: Feb. 21, 1995

[54] ALLOY SUBSTITUTE FOR MERCURY IN SWITCH APPLICATIONS

[75] Inventors: Larry T. Taylor; James Rancourt, both of Blacksburg; Carlos Perry, Jr., Manassas, all of Va.

[73] Assignee: The Center for Innovative Technology, Herndon, Va.

[21] Appl. No.: 22,118

[22] Filed: Feb. 25, 1993

[51] Int. Cl.[6] ..... H01H 29/06

[52] U.S. Cl. ..... 200/233

[58] Field of Search ..... 200/233, 234

[56] References Cited

U.S. PATENT DOCUMENTS

| | | | |
|---|---|---|---|
| 3,462,573 | 8/1969 | Rabinowitz et al. | 200/233 |
| 5,021,618 | 6/1991 | Ubukata et al. | 200/233 |

FOREIGN PATENT DOCUMENTS

| | | | |
|---|---|---|---|
| 59-123736 | 7/1984 | Japan . | |
| 62-4459 | 1/1987 | Japan . | |
| 625264 | 9/1978 | U.S.S.R. | 200/234 |
| 799044 | 1/1981 | U.S.S.R. . | |
| 862282 | 9/1981 | U.S.S.R. . | |
| 306567 | 4/1987 | U.S.S.R. . | |

*Primary Examiner*—Renee S. Luebke

*Attorney, Agent, or Firm*—Whitham, Curtis, Whitham & McGinn

[57] ABSTRACT

With proper handling, Gallium-Indium-Tin eutectics are suitable for use as a substitute for mercury in switch applications. The eutectics should be acid washed to prevent oxidation of the metal components of the eutectic while in the switch housing and, further, the switch housing should be filled with an inert gas. Preventing oxidation ensures long term performance of the switch. In addition, provisions need to be made to prevent wetting of the switch housing by the eutectic. Experiments have shown that acid washing of metallic switch housings prior to adding the Gallium-Indium-Tin eutectic reduces or eliminates wetting by the eutectic. In addition, experiments have shown that coating the walls of the switch housing with a fluoropolymer coating prevents wetting by the eutectic.

7 Claims, 1 Drawing Sheet

ALLOY SUBSTITUTE FOR MERCURY IN SWITCH APPLICATIONS

BACKGROUND OF THE INVENTION

1. Field of the Invention

The invention is generally related to electrical switches which use a conducting fluid to selectively provide a conductive bridge between the space separating two electrodes and, more particularly, to non-toxic substitutes for mercury (Hg) which have similar performance characteristics in switch applications.

2. Description of the Prior Art

Mercury is used extensively in switches and sensors. In a common switch application, liquid mercury is positioned inside a fluid tight housing into which a pair of spaced apart electrodes extend. Depending on the physical orientation of the housing, the liquid mercury can provide a conductive pathway between the electrodes or be positioned such that there is an open circuit between the electrodes. An important physical attribute of mercury metal is that it remains fluid throughout a wide temperature range, and can therefore be used in many different environments and in environments with constantly changing parameters. Another important physical attribute of mercury metal is that it has significant surface tension and does not wet many glass, polymer or metal surfaces.

Mercury metal is sufficiently toxic that human and animal exposure is a significant concern in any application or process in which it is used. Concentrations as low as 0.03 mg/m$^3$ have induced psychiatric symptoms in humans. Mercury has also been identified as disrupting the endocrine system in certain wildlife and possibly in humans. Utilization of mercury during manufacturing may present a health hazard to plant personnel, and the disposal of devices that contain mercury switches or the accidental breakage of mercury switches during use may present indirect hazard to people within the immediate vicinity of the switch.

Japanese Patent Application Sho 57-233016 to Inage et al. discloses a metallic alloy which includes 75% gallium, 19–29% indium, 1–11% tin, and 1–3.5% silver, and discusses its usefulness as a possible substitute for mercury. This alloy has low toxicity, is not very volatile at normal temperatures, has a temperature of congealment below 0° C., and has a resistance of 32 $\mu\Omega$/cm at 20° C. This patent also identifies Japanese Patent Disclosure Sho 50-101208 as describing a gallium based alloy which includes indium, tin, zinc, silver, and aluminum.

SUMMARY OF THE INVENTION

It is an object of this invention to provide an electrically conductive liquid filled switch which has performance characteristics similar to mercury switches, but which does not suffer from the toxicity problems inherent in mercury switches.

According to the invention, substitute electrically conductive liquid filled switches include a gallium-indium-tin eutectic. Additional elements can be combined with the eutectic to lower the melting point for a desired application. A mild acid wash procedure is used to clean the metals used in the switch. The switch housing is coated with a material which is not wet by the eutectic, and the switch element is filled with a nonoxidizing gas at atmospheric or elevated pressure.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENTS OF THE INVENTION

Figure 1A:
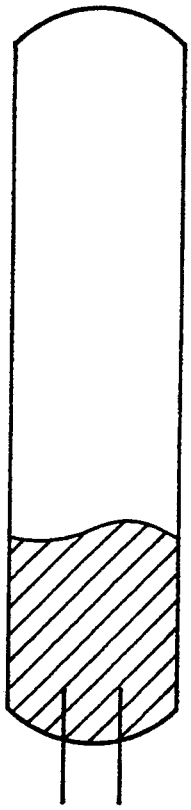
FIGS. 1*a* and 1*b* are drawings of coated and uncoated glass capsules filled with eutectic which have been inverted and returned to their original orientation, respectively.

In order to serve as a suitable replacement for mercury in switch applications, the substitute electrically conductive liquid should have properties that are similar to mercury, except for toxicity, so that the replacement liquid can be readily implemented into existing manufacturing programs. Tables 1 and 2 set forth the requirements of a suitable replacement liquid and the basic properties of mercury metal, respectively.

TABLE 1

DESIRABLE CHARACTERISTICS OF CONTACT SWITCHES CONSTRUCTED WITH MERCURY OR ALTERNATE LIQUID CONDUCTORS

| Replacement | | Mercury |
|---|---|---|
| R | ✓ | Low resistivity |
| R | ✓ | Low contact resistance |
| D | ✓ | Compatible with glass envelopes |
| D | ✓ | Compatible with metal envelopes |
| R | ✓ | Non-corrosive |
| R | X | Non-toxic |
| D | ✓ | Inexpensive |
| D | ✓ | Approximately 15 Ampere capacity |
| D | ✓ | Perform in alternating and direct current application |
| R | ✓ | Rapid Response Time |
| D | m.p.−38° C. | Wide temperature of operation |

D, desirable
R, required
✓, indicates property is possessed by mercury
X, indicates property is not possessed by mercury

TABLE 2

PROPERTIES OF MERCURY METAL

| | |
|---|---|
| ~480 | dyne/cm surface tension at 20° C. |
| 13.546 | specific gravity at 20° C. |
| 98 | microohm · cm electrical resistivity |
| 0.002 | mmHg vapor pressure at 25° C. |
| −38° C. | melting point |
| 357° C. | boiling point |
| 1.55 cps | viscosity at 20° C. |
| — | acts as a cumulative poison |
| — | air saturated with mercury at 20° C. contains a concentration of mercury that exceeds the toxic limit by more than 100 times |
| — | relatively inexpensive |

It has been discovered that an appropriately processed gallium-indium-tin eutectic or gallium-indium-tin-X eutectic positioned within a switch housing coated with a material which is not wet by the eutectic will have performance characteristics similar to mercury in electrically conductive fluid switch applications. The eutectic contains no components which are as toxic as mercury, and the components have higher boiling points (lower vapor pressures) than mercury. Hence, the eutectic is much less dangerous than mercury and there is a significantly lower airborne concentration of the eutectic.

Tables 3 and 4 list the properties of a number of chemical elements and melting points of a number of alloys.

TABLE 3

PROPERTIES OF SELECT CHEMICAL ELEMENTS

| Element | Atomic number | Microohm-Cm | M.P. Celsius | B.P. |
|---|---|---|---|---|
| Lithium | 3 | 9 | 181 | 1347 |
| Sodium | 11 | 4 | 98 | 882.9 |
| Potassium | 19 | 6 | 64 | 774 |
| Gallium | 31 | 17 | 30 | 2403 |
| Selenium | 34 | 12 | 217 | 684.9 |
| Rubidium | 37 | 13 | 39 | 688 |
| Cadmium | 48 | 7 | 321 | 765 |
| Indium | 49 | 8 | 157 | 2080 |
| Tin | 50 | 11 | 232 | 2270 |
| Cesium | 55 | 20 | 28 | 678.4 |
| Mercury | 80 | 98 | −39 | 356.58 |
| Thallium | 81 | 18 | 304 | 1457 |
| Lead | 82 | 21 | 328 | 1740 |
| Bismuth | 83 | 107 | 271 | 1560 |
| Silver | 47 | 2 | 962 | 2212 |
| Gold | 79 | 2 | 1064 | 2807 |
| Palladium | 46 | 11 | 1552 | 3140 |
| Platinum | 78 | 11 | 1772 | 3827 |

TABLE 4

MELTING POINT OF ALLOYS
Weight Percent of Element is Indicated

| Sodium | Potassium | Rubidium | Cesium | M.P.(°C.) |
|---|---|---|---|---|
| | 23 | | 77 | −48 |
| | | 13 | 87 | −40 |
| 5 | | | 95 | −30 |
| 22 | 78 | | | −11 |
| 8 | | 92 | | −8 |
| 100 | | | | 97 |
| | 100 | | | 64 |
| | | 100 | | 39 |
| | | | 100 | 28 |

| Gallium | Indium | Tin | M.P.(°C.) |
|---|---|---|---|
| 62.5 | 21.5 | 16.0 | 10.7 |
| 69.8 | 17.6 | 12.5 | 10.8 |
| 74.5 | 24.5 | | 15.7 |
| 100 | | | 29.8 |
| | 100 | | 156.6 |
| | | 1000 | 232.0 |

Gallium-Indium-Tin eutectics are commercially available (e.g., Johnson Matthey 99.99% purity). Gallium-Indium-Tin eutectics set forth in Table 4 have a melting point of approximately 11° C., and this melting point cannot be lowered further with any combination of these three elements. However, as is shown in Japanese Patent Application Sho 57-233016 to Inage et al., adding small amounts of silver to the eutectic can lower the melting point below 0° C. The elements listed in Table 3 and the binary mixtures of alkali metals listed in the top part of Table 4 could also be advantageously added to the Gallium-Indium-Tin eutectic to lower its melting point. Note that some of the binary eutectic mixtures in Table 4 have a lower melting point than mercury.

In the switch applications employing Gallium-Indium-Tin eutectics contemplated by this invention, the primary component is gallium and it should constitute 60–75 wt % of the alloy. Indium is incorporated in the alloy in the range of 15–30 wt %. Tin is incorporated in the alloy in the range of 1–16 wt %. Additional chemical elements, such as those set forth in Tables 3 and 4, if they are employed in the alloy, constitute 0–5 wt % of the alloy. The preferred additional elements would be lithium, sodium, potassium, rubidium, silver, gold, platinum, palladium, cesium and bismuth, since these elements do not pose the toxicity hazards of mercury.

Gallium-Indium-Tin eutectics are electrically conductive and should be able to handle both AC and DC current equally well.

Oxidation of the metals in the eutectic can pose a serious problem for switch performance. For example, in the Gallium-Indium-Tin-Silver eutectic disclosed in the Japanese Patent Application Sho 57-233016 to Inage et al. the silver component is easily oxidized. A composition containing an oxidized component will have increased resistance and may suffer from other deficiencies.

During manufacturing of the electrically conductive liquid filled switches of this invention, provisions are made to prevent oxidation. In this invention, all components used in the switch application are thoroughly washed in a mild acid solution (e.g., acetic acid, dilute hydrochloric acid, etc.) prior to being combined and placed in a switch housing. This reduces the surfaces of the metal components and makes oxidation less likely. Preferably, the acid wash is performed while the metal is in liquid state and is aided by mechanical agitation.

In addition, the switch housing is preferably filled with an inert gas, e.g., helium, nitrogen, argon, hydrogen, etc., (instead of a vacuum, although a vacuum atmosphere can be employed). The inert gas assures that the atmosphere above the eutectic is nonoxidizing, thereby allowing the eutectic to retain long term performance properties in the switch. The inert gas could be present at atmospheric or elevated pressure. Besides preventing oxidation of the eutectic, the inert gas serves the function of an arc suppressant. In highly explosive applications, Argon would be the preferred inert gas.

Metal wetting of or reaction with the switch housing is a serious problem for liquid filled switches. Mercury has the advantage of a high surface tension and exhibits little wetting of glass or metal housings. Experiments have shown that Gallium-Indium-Tin eutectics either wet the surfaces of glass switch housings or chemically react with the glass or absorbed moisture on the glass. In addition, the Gallium-Indium-Tin eutectic also wets high density polyethylene.

After evaluating a number of coating materials which can provide uniform coatings on glass plates, tubes and bottles, it was discovered that a fluoroalkyl acrylate polymer coating (e.g., 3M FC-725 Flourad Brand Conformal Coating available from Minnesota Mining and Manufacturing) was not wet by the eutectic. Therefore, coating the switch housing with a fluoroalkyl acrylate polymer, soluble fluoropolymer, or related polymer coating which is not wet by the eutectic is preferred.

Figure 1B:
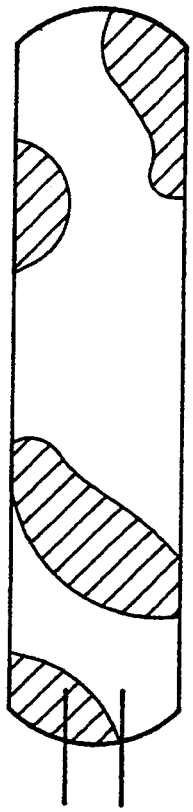

FIGS. 1*a* and 1*b* show a comparison of two glass switch capsules that contain Gallium-Indium-Tin eutectic. The interior of the glass switch capsule in FIG. 1*a* was coated with a fluoroalkyl acrylate polmer prior to adding the eutectic, while the interior of the glass switch capsule in FIG. 1*b* was only cleaned. Each switch capsule was inverted and then returned to its original position. FIG. 1*a* clearly shows that the fluoroalkyl acrylate polymer eliminates the adhesion of the Gallium-Indium-Tin eutectic to glass.

It was also discovered that washing the surfaces of the switch with mild acid (dilute HCl or acetic acid, etc.) reduces or eliminates the adhesion of the eutectic to the switch components. Acid washing has particular application in switches that are constructed with metal (steel, etc.) instead of glass (although acid washing can provide beneficial dewetting effects in glass). Specifically, it was observed that, when acid-treated, the eutectic does not wet the electrodes, the metal switch casing, or the ceramic (glass) material which separates the electrodes and metal switch casing. The acid wash reduces the surfaces of the metal which might otherwise react with the eutectic.

While the invention has been described in terms of its preferred embodiments, those skilled in the art will recognize that the invention can be practiced with modification within the spirit and scope of the appended claims.

We claim:

1. A method of preparing a switch, comprising the steps of:

washing an electrically conductive fluid comprised of gallium, indium and tin with an acid wash;

providing a means for preventing the electrically conductive fluid from wetting interior walls of a switch housing; and depositing said electrically conductive fluid into said switch housing after said steps of washing and providing.

2. A method as recited in claim 1 wherein said step of providing is achieved by acid washing said interior walls of said switch housing.

3. A method as recited in claim 1 wherein said step of providing is achieved by coating said interior walls of said switch housing with a polymeric coating which is not wet by said electrically conductive fluid.

4. A method as recited in claim 3 wherein said polymeric coating is selected from the group consisting of fluoropolymers and fluoroalkyl acrylate polymers.

5. A method as recited in claim 1 further comprising the step of filling a volume in said switch housing not occupied by said electrically conductive fluid with an inert gas.

6. A method as recited in claim 5 wherein said inert gas used in said filling step is selected from the group consisting of hydrogen, helium, argon, and nitrogen.

7. A method as recited in claim 5 wherein said inert gas is argon.

* * * * *